US005651626A

United States Patent [19]

Chen

[11] Patent Number: 5,651,626

[45] Date of Patent: Jul. 29, 1997

[54] RETRACTABLE CLIP ACTUATED PEN

[76] Inventor: Jang-Mau Chen, No. 6-2, Alley 18, Lane 265, Sec. 2, Ta Kuan Rd., Panchiao City, Taipei Hsien, Taiwan

[21] Appl. No.: 676,733

[22] Filed: Jul. 8, 1996

[51] Int. Cl.[6] ..... B43K 24/02; B43K 24/04; B43K 7/12

[52] U.S. Cl. ..... 401/104; 401/99; 401/109

[58] Field of Search ..... 401/99, 109, 104

[56] References Cited

U.S. PATENT DOCUMENTS

| | | | |
|---|---|---|---|
| 2,896,577 | 7/1959 | Merryman et al. | 401/112 |
| 4,917,519 | 4/1990 | White et al. | 401/109 X |

FOREIGN PATENT DOCUMENTS

| | | | |
|---|---|---|---|
| 508090 | 6/1955 | Italy | 401/109 |
| 1680585 | 9/1991 | U.S.S.R. | 401/104 |

*Primary Examiner*—Steven A. Bratlie

*Attorney, Agent, or Firm*—Beveridge, DeGrandi, Weilacher & Young, L.L.P.

[57] ABSTRACT

A pen including a barrel, a spring supported refill mounted in the barrel, a pressure member pivoted to a longitudinal extension strip at one end of the barrel, an actuating member mounted around the longitudinal extension strip and moved between the barrel and the pressure member, and a spring mounted around the upper barrel section of the barrel and stopped between the lower barrel section of the barrel and the actuating member, wherein when the pressure member is turned outwards, the actuating member is forced downwards to push the refill out of the barrel; when the pressure member is turned inwards, the spring is released, and the actuating member is forced upwards by the spring, thereby causing the refill to be moved back into the inside of the barrel.

1 Claim, 8 Drawing Sheets

RETRACTABLE CLIP ACTUATED PEN

BACKGROUND OF THE INVENTION

The present invention relates to pens, and relates more particularly to such a pen which can be conveniently operated to extend the refill out of the barrel for writing, or to receive the refill back to the inside of the barrel when not in use.

Regular pens are commonly equipped with a press button or rotary cap adapted for controlling the position of the refill. When the press button is pressed down or the rotary cap is twisted clockwise, the refill is forced out of the barrel for writing. After writing, the press button is released or the rotary cap is twisted counter-clockwise, thereby causing the refill to be received back inside the barrel. The mechanism which is coupled between the refill and the rotary cap/press button cap tends to be damaged after long uses of the rotary cap/press button cap, thereby causing the pen unable to work properly.

SUMMARY OF THE INVENTION

It is one object of the present invention to provide a pen which can be conveniently operated to move the refill in and out of the barrel. It is another object of the present invention to provide a refill movement control mechanism for a pen which is durable in use. According to the preferred embodiment of the present invention, the pen comprises a barrel, the barrel comprising a lower barrel section having an inner thread at a top end thereof, and an upper barrel section having an outer thread at a bottom end thereof threaded into the inner thread of the lower barrel section and two longitudinal grooves bilaterally disposed at a top end thereof and a longitudinal extension strip longitudinally extending from the top end; a first spring mounted inside the lower barrel section; a refill supported on the first spring and moved in and out of the barrel; a pressure member coupled to the longitudinal extension strip of the upper barrel section, and turned between a first position in which the refill is pushed back inside the barrel by the first spring, and a second position in which the refill is forced out of the barrel by an actuating member, the pressure member comprising a finger strip longitudinally disposed at one end for turning by hand, two parallel press blocks disposed at an opposite end and pivotably connected to the longitudinal extension strip of the upper barrel section at two opposite sides by a pivot, and a space defined between the press blocks which receives the longitudinal extension strip of the upper barrel section; an actuating member mounted around longitudinal extension strip of the upper barrel section and forced by the pressure member to push the refill out of the barrel for writing, the actuating member having a longitudinal through hole for the passing of the longitudinal extension strip of the upper barrel section, and two inward flanges adapted for engaging the longitudinal grooves of the upper barrel section, the inward flanges being forced into engagement with the longitudinal grooves of the upper barrel section to push the refill out of the barrel when the pressure member is turned from the first position to the second position, the inward flanges being released from the longitudinal grooves of the upper barrel section when the pressure member is turned from the second position to the first position; and a second spring mounted around the upper barrel section and stopped between the lower barrel section and the actuating member to impart an upward pressure to the actuating member.

DETAILED DESCRIPTION OF THE PREFERRED EMBODIMENT

Figure 1:
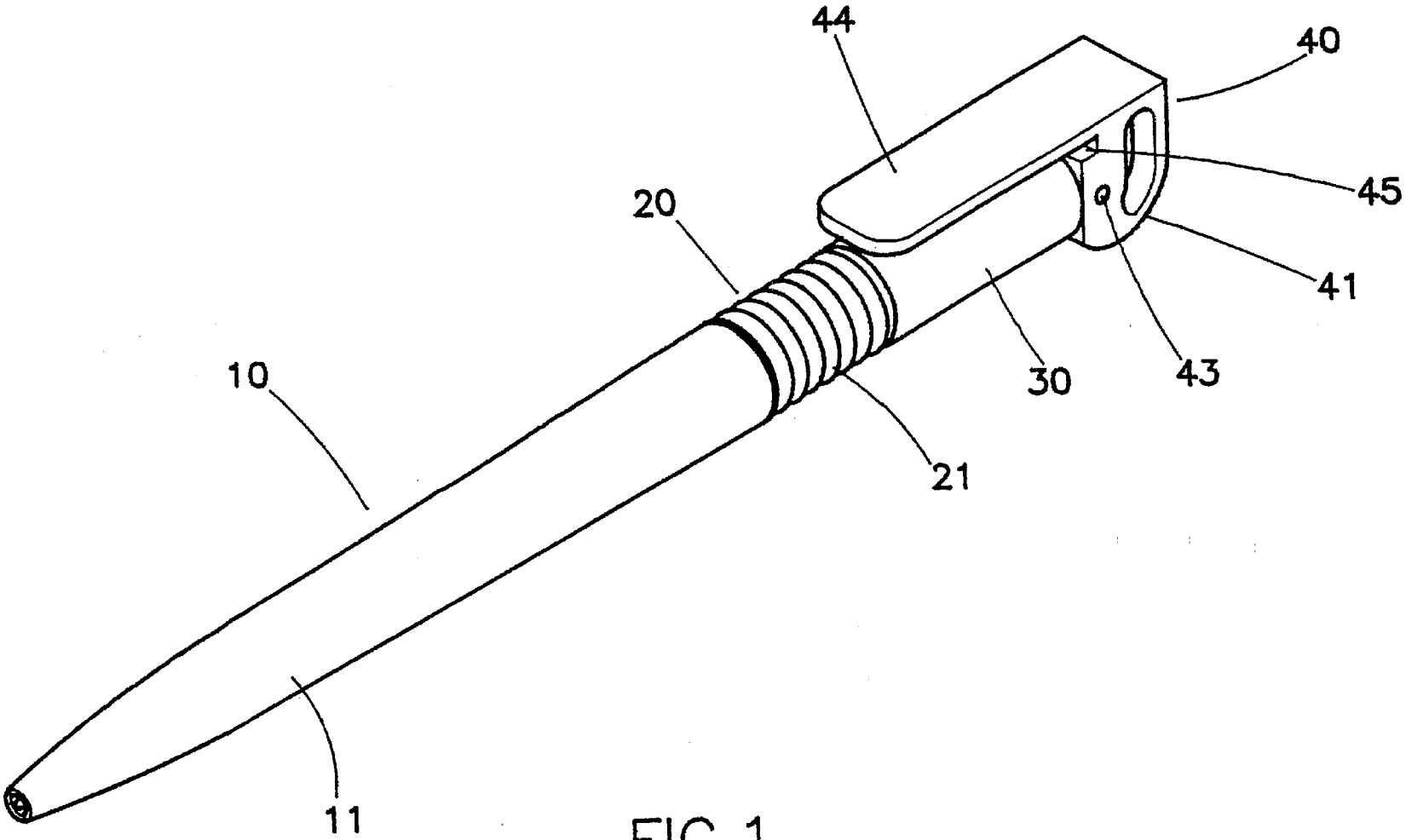
FIG. 1 is an elevational view of a pen according to the present invention.
Figure 2:
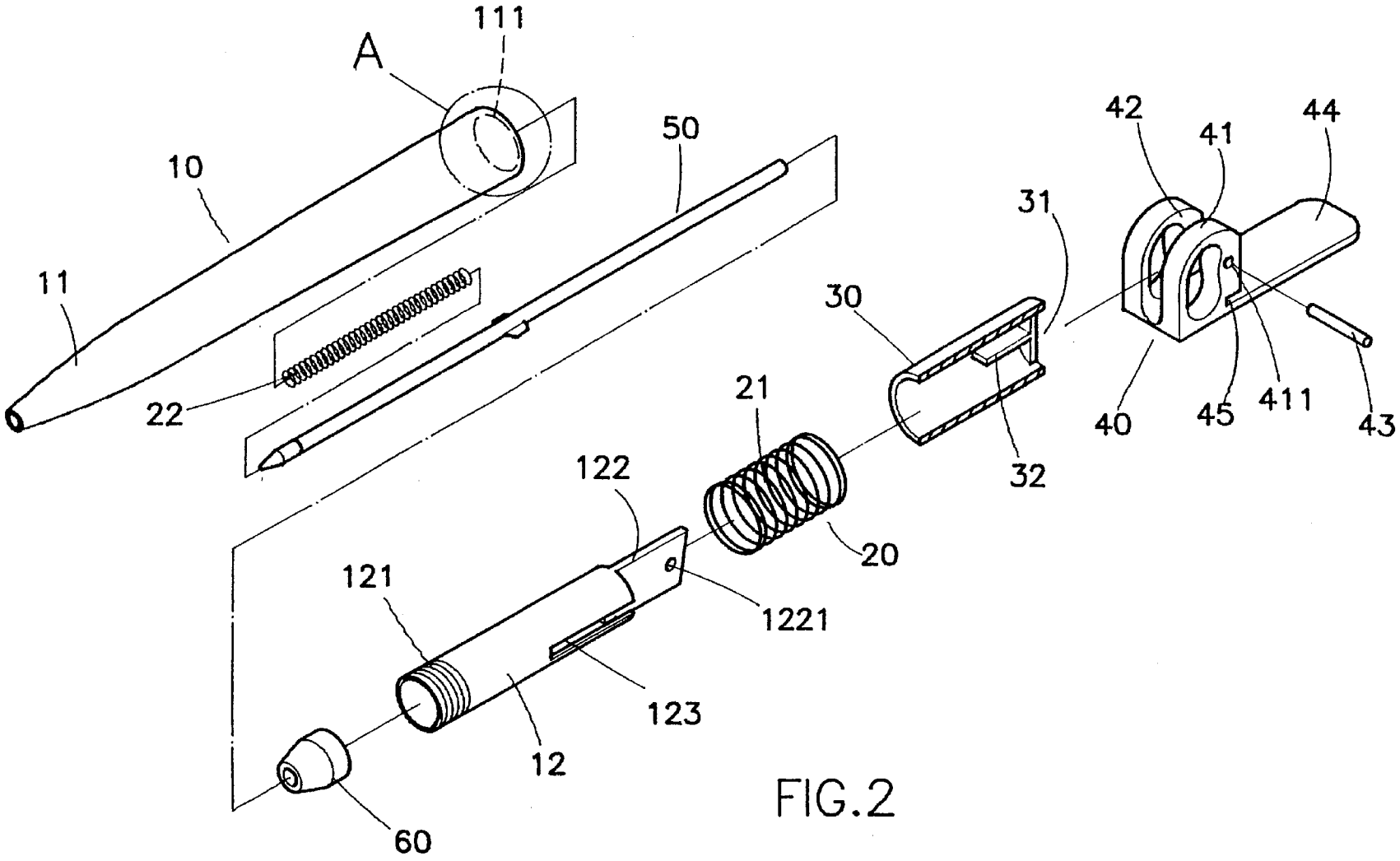
FIGS. 2 and 2A are an exploded view of the pen shown in FIG. 1.
Figure 2A:
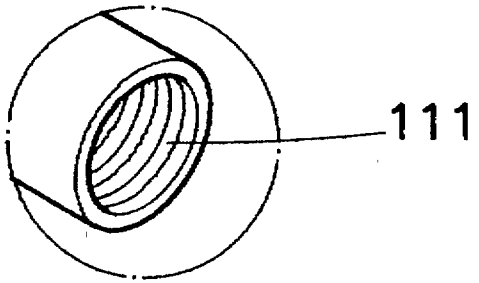
Figure 3:
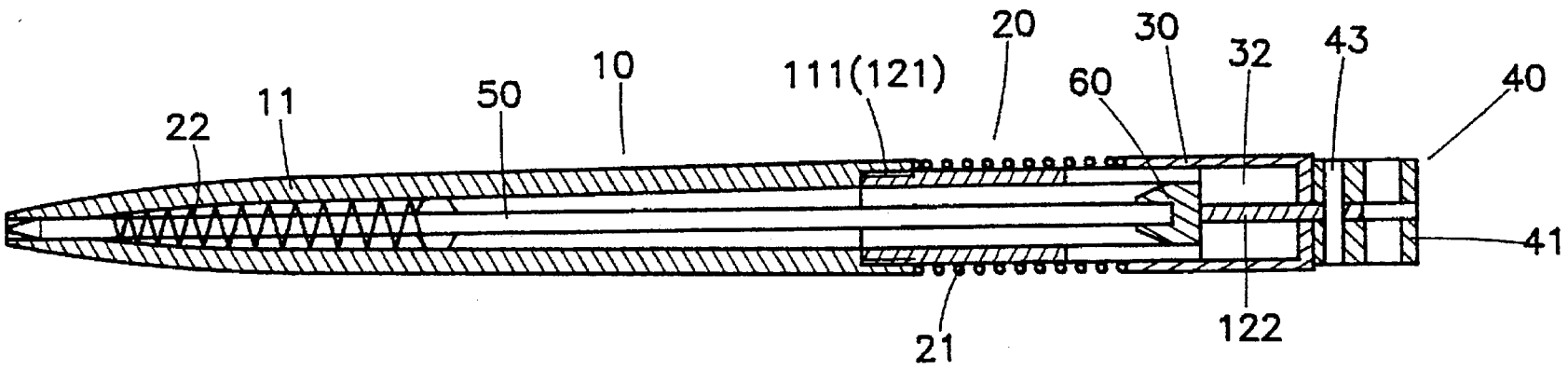
FIG. 3 is a longitudinal view in section of the pen shown in FIG. 1.

Referring to FIGS. 1, 2, 2A, and 3, a pen in accordance with the present invention is generally comprised of a barrel 10, a spring set 20, an actuating member 30, a pressure member 40, a refill 50, and a top cap 60. The spring set 20 is comprised of a first spring 22, and a second spring 21. The refill 50 is mounted in the barrel 10. The top cap 60 is fastened to the top end of the refill 50. The first spring 22 is mounted around the refill 50 within the barrel 10. The barrel 10 is comprised of a lower barrel section 11 and an upper barrel section 12. The lower barrel section 11 has an inner thread 111 at the top. The upper barrel section 12 has an outer thread 121 at the bottom threaded into the inner thread 111 of the lower barrel section 11, two longitudinal grooves 123 longitudinally and bilaterally extending to the top, and a longitudinal extension strip 122 extending from the top and having a pivot hole 1221. The second spring 22 is mounted around the upper barrel section 12 and stopped between the lower barrel section 11 and the actuating member 30. The actuating member 30 has two inward flanges 32 bilaterally disposed on the inside and respectively forced into engagement with the longitudinal grooves 123 of the upper barrel section 12, and a longitudinal through hole 31 for the passing of the extension strip 122. The pressure member 40 comprises two parallel press blocks 41 spaced by a space 42 at one end, a finger strip 44 at an opposite end, and a transverse hanging groove 45 defined between the press blocks 41 and the finger strip 44 and adapted for hanging on the pocket. The press blocks 41 have a respective transverse pivot hole 411 aligned together. When the longitudinal extension strip 122 of the upper barrel section 12 is inserted through the longitudinal through hole 31 of the actuating member 30, the pivot hole 1221 is pivotably connected between the pivot holes 411 of the press blocks 41 by a pivot pin 43.

Figure 4:
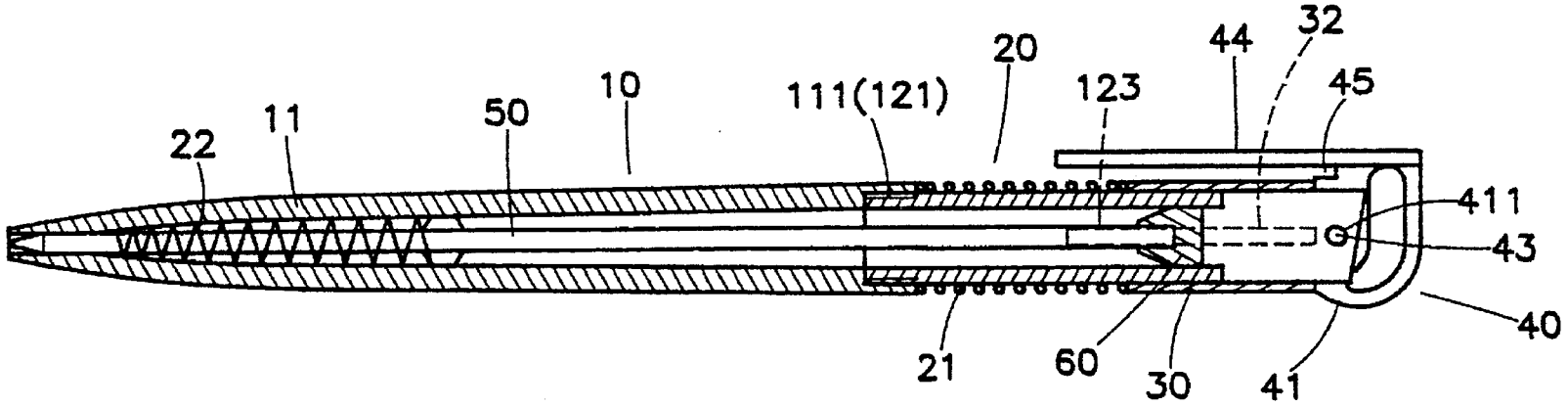
FIG. 4 shows the pressure member turned inwards and the refill received inside the barrel according to the present invention.
Figure 5:
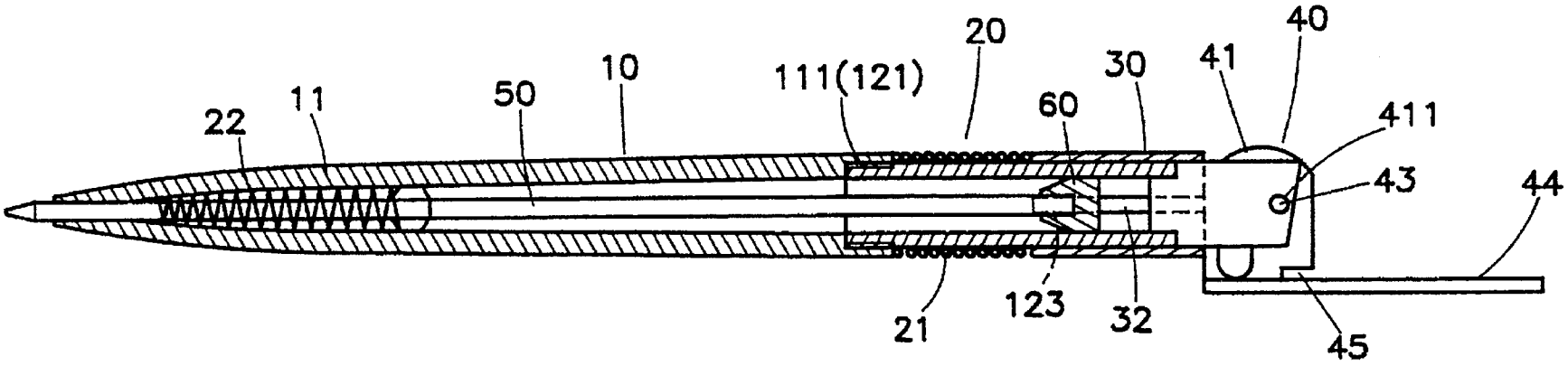
FIG. 5 shows the pressure member turned outwards and the refill extended out of the barrel.

Referring to FIGS. 4 and 5, when the finger strip 44 of the pressure member 40 is turned outwards from the position shown in FIG. 4 to the position shown in FIG. 5, the actuating member 30 is forced downwards by the press blocks 41 of the pressure member 40, thereby causing the inward flanges 32 of the actuating member 30 to be respectively forced into engagement with the longitudinal grooves 123 of the upper barrel section 12 and the cap 60 to be forced downwards by the inward flanges 32 of the actuating member 30, and therefore the refill 50 is forced out of the lower barrel section 11 for writing and the first spring 22 is compressed; on the contrary, when the finger strip 44 of the pressure member 40 is turned inwards from the position shown in FIG. 5 to the position shown in FIG. 4, the actuating member 30 is released from the pressure of the press blocks 41 of the pressure member 40 and pushed upwardly back to its former position by the second spring 21, thereby causing the inward flanges 32 of the actuating member 30 to be released from the longitudinal grooves 123 of the upper barrel section 12 and the refill 50 to be pushed back to the inside of the barrel 10 by the first spring 22.

Figure 6:
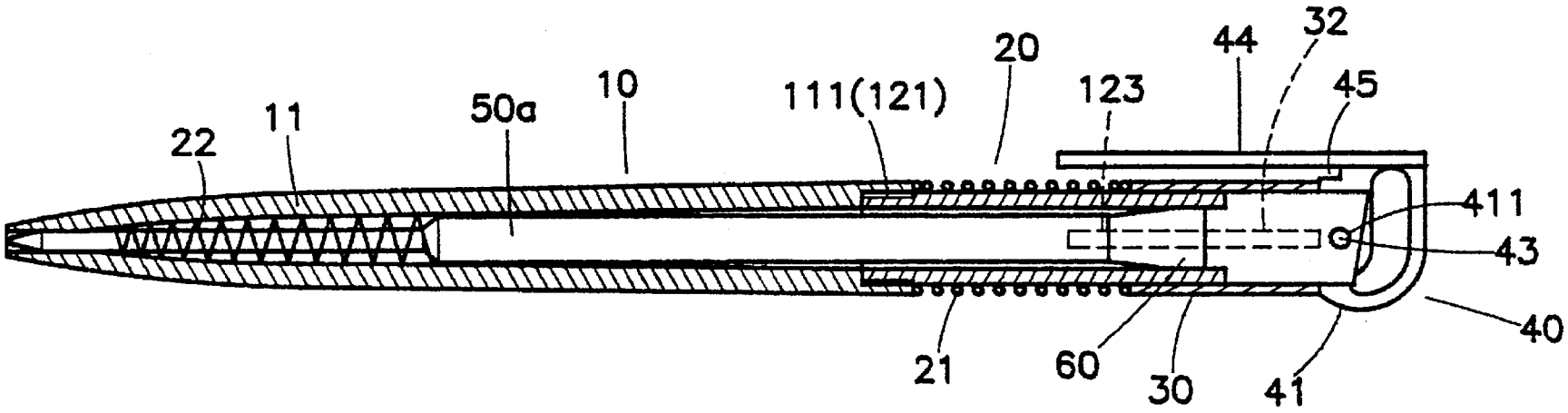
FIG. 6 shows a thick refill used and installed in the barrel according to the present invention.

FIG. 6 and FIG. 5 again, when a thick refill 50*a* is used, the aforesaid cap 60 may be eliminated. However, if a thin refill 50 is used, the aforesaid cap 60 must be used so that the refill 50 can be positively moved by the inward flanges 32 of the actuating member 30.

Figure 7:
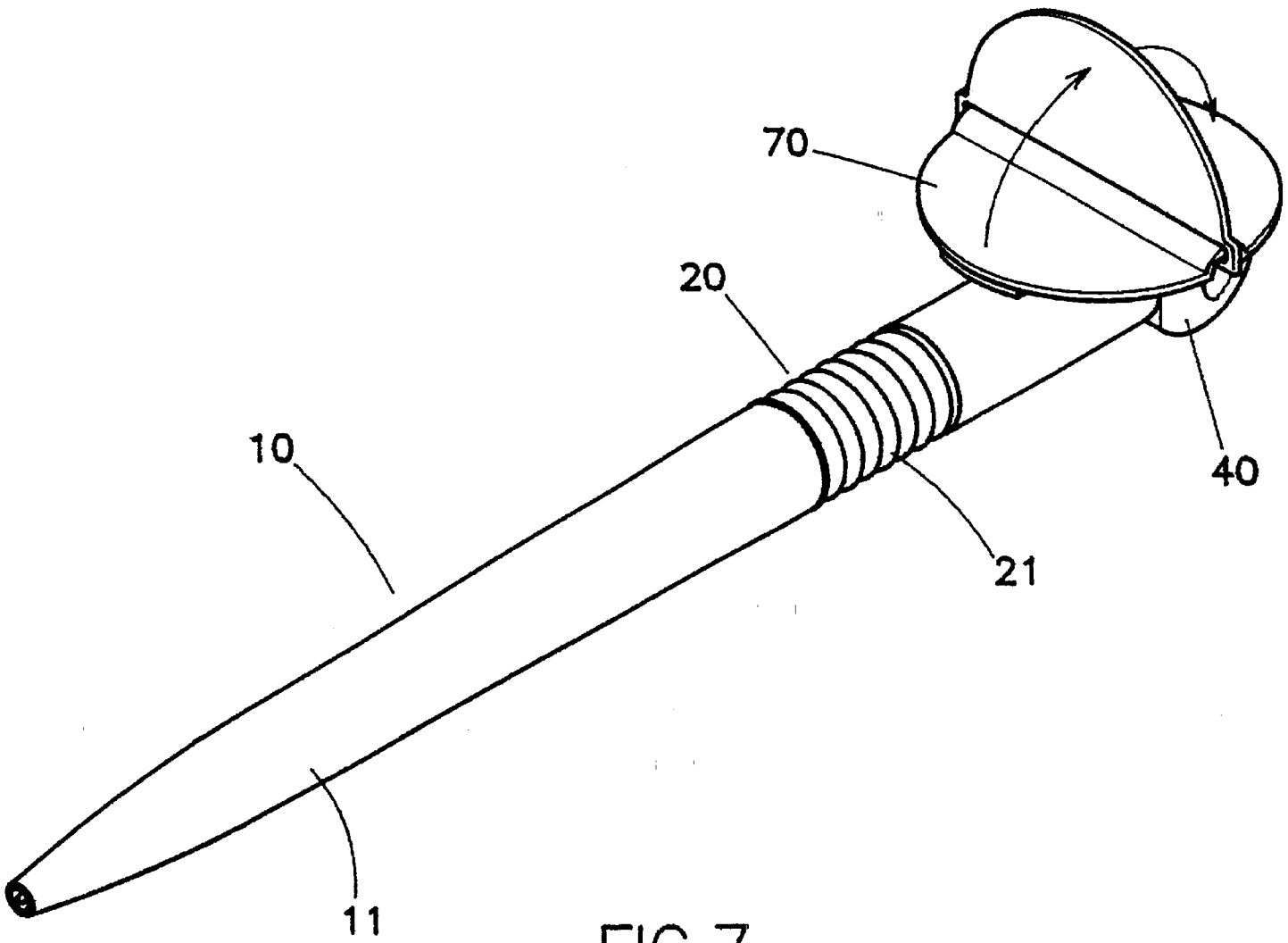
FIG. 7 is an elevational view of an alternate form of the present invention, showing a liftable display board pivoted to the pressure member.
Figure 8:
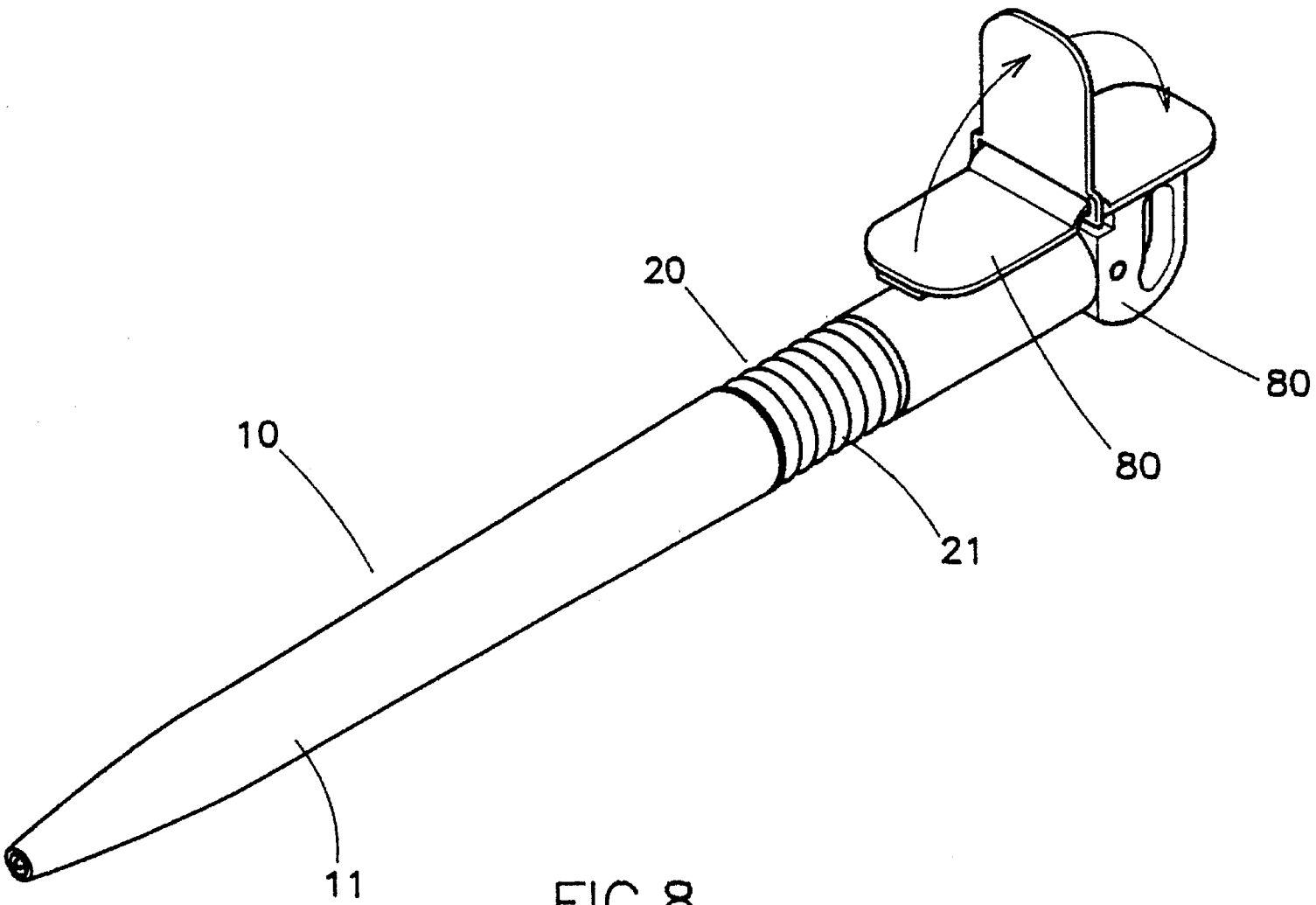
FIG. 8 is an elevational view of another alternate form of the present invention, showing another shape of liftable display board pivoted to the pressure member.

Referring to FIGS. 7 and 8, liftable display board 70 or 80 may be pivoted to the finger strip 44 of the pressure member 40 for displaying advertising words or drawings etc.

It is to be understood that the drawings are designed for purposes of illustration only, and are not intended as a definition of the limits and scope of the invention disclosed.

What the invention claimed is:

1. A pen comprising:

a barrel, said barrel comprising a lower barrel section having an inner thread at a top end thereof, and an upper barrel section having an outer thread at a bottom end thereof threaded into the inner thread of said lower barrel section and two longitudinal grooves bilaterally disposed at a top end thereof and a longitudinal extension strip longitudinally extending from the top end;

a first spring mounted inside said lower barrel section;

a refill supported on said first spring and moved in and out of said barrel;

a pressure member coupled to the longitudinal extension strip of said upper barrel section, and turned between a first position in which said refill is pushed back inside said barrel by said first spring, and a second position in which said refill is forced out of said barrel by an actuating member, said pressure member comprising a finger strip longitudinally disposed at one end for turning by hand, two parallel press blocks disposed at an opposite end and pivotably connected to the longitudinal extension strip of said upper barrel section at two opposite sides by a pivot, and a space defined between said press blocks which receives the longitudinal extension strip of said upper barrel section;

an actuating member mounted around longitudinal extension strip of said upper barrel section and forced by said pressure member to push said refill out of said barrel for writing, said actuating member having a longitudinal through hole for the passing of the longitudinal extension strip of said upper barrel section, and two inward flanges adapted for engaging the longitudinal grooves of said upper barrel section, said inward flanges being forced into engagement with the longitudinal grooves of said upper barrel section to push said refill out of said barrel when said pressure member is turned from said first position to said second position, said inward flanges being released from the longitudinal grooves of said upper barrel section when said pressure member is turned from said second position to said first position; and a second spring mounted around said upper barrel section and stopped between said lower barrel section and said actuating member to impart an upward pressure to said actuating member.

* * * * *